US008292307B2

(12) United States Patent
Zampieri

(10) Patent No.: US 8,292,307 B2
(45) Date of Patent: Oct. 23, 2012

(54) IN-LINE ROLLER SKATE, IN PARTICULAR RACING SKATE

(75) Inventor: Claudio Zampieri, Tombolo (IT)

(73) Assignee: Nordica S.p.A., Giavera del Montello (TV) (IT)

( * ) Notice: Subject to any disclaimer, the term of this patent is extended or adjusted under 35 U.S.C. 154(b) by 270 days.

(21) Appl. No.: 12/715,066

(22) Filed: Mar. 1, 2010

(65) Prior Publication Data

US 2010/0219596 A1 Sep. 2, 2010

(30) Foreign Application Priority Data

Mar. 2, 2009 (EP) ..... 09425082

(51) Int. Cl.
*A63C 17/02* (2006.01)
*A63C 17/00* (2006.01)
*A63C 17/04* (2006.01)

(52) U.S. Cl. ..... 280/11.221; 280/11.19; 280/11.231

(58) Field of Classification Search ..... 280/11.19, 280/11.221, 841, 11.231, 11.27
See application file for complete search history.

(56) References Cited

U.S. PATENT DOCUMENTS 1,866,134 A * 7/1932 Smith ..... 280/11.223
5,135,244 A * 8/1992 Allison ..... 280/11.28
5,853,179 A * 12/1998 Chapman ..... 280/11.232
5,890,724 A * 4/1999 Gignoux et al. ..... 280/11.28
6,161,846 A * 12/2000 Soderberg ..... 280/11.225
6,186,518 B1 * 2/2001 Moses ..... 280/11.225
6,446,984 B2 * 9/2002 Grande et al. ..... 280/11.223
6,712,395 B1 * 3/2004 Lee ..... 280/11.19
6,736,412 B1 * 5/2004 Krah ..... 280/11.224
2007/0063458 A1 * 3/2007 Bont ..... 280/11.221
2009/0045596 A1 * 2/2009 Boucher ..... 280/11.223

FOREIGN PATENT DOCUMENTS

WO 94/46291 A1 12/1997
WO 97/46291 A1 12/1997
WO 2004/087270 A1 10/2004

* cited by examiner

*Primary Examiner* — J. Allen Shriver, II
*Assistant Examiner* — James M Dolak
(74) *Attorney, Agent, or Firm* — Sughrue Mion, PLLC

(57) ABSTRACT

In-line roller skate (1), in particular racing skate, comprising a pair of side frame elements (5*a*, 5*b*), joined to each other by at least a transversal frame element (5*c*), between which a front wheel (7*a*), a rear wheel (7*d*) and at least two intermediate wheels (7*b*, 7*c*) are pivotally mounted, and a skate boot (3) provided with a sole (3*a*), said boot being fastened to said frame through a fastening portion (9), wherein said fastening portion (9) is located between said sole and said frame in a substantially central region (F) in the longitudinal direction between said front and rear wheels.

19 Claims, 4 Drawing Sheets

IN-LINE ROLLER SKATE, IN PARTICULAR RACING SKATE

TECHNICAL FIELD

The present invention relates to an in-line roller skate, in particular to a racing skate.

In-line racing skates are provided with wheels having an increased diameter with respect to skates commonly sold for leisure.

More particularly, according to the regulations of the International Speed Skating Committee (C.I.C.—Comité Internacional de Course), in-line roller skates can have up to six wheels and the maximum diameter of the wheels can reach 110 mm, while in-line roller skates commonly sold for leisure are provided with wheels having a diameter of about 80 mm.

PRIOR ART

In racing skates, the need is particularly felt for wheels having an increased diameter, in order to improve the skate performances during the race, namely in terms of power transmission and speed.

However, the increase in wheel diameter implies an increase in the frame height and in the distance of the skate boot from the sliding plane and, consequently, an increase in the distance of the user's centre of gravity from said plane, which involves a reduction in skate stability.

In order to keep both the frame height and the distance of the skate boot from the sliding plane limited, in Patent Application WO 97/46291 a skate is proposed which is provided with four aligned wheels, wherein the front and the rear wheels have an increased diameter, while the intermediate wheels have a smaller diameter. By mounting the skate boot on the skate frame at the intermediate wheels, the distance of said boot from the sliding plane can be kept limited.

Such a solution has evident drawbacks, since the use of wheels having different diameters can cause instabilities and vibrations, consequently inducing a loss of skate control and a lower efficiency in the thrust power.

With reference to FIG. 1, patent application WO 2004/087270 discloses an in-line roller skate 101 provided with wheels 108 all having an increased diameter. In order to keep both the frame height H and the distance of the sole 103 of the skate boot 102 from the sliding plane limited, the boot fastening means 105,111—instead of being arranged at the two central wheels—are provided at a greater distance from each other: more precisely, first fastening means 111 are provided between the first and the second wheel, in the toe region, while second fastening means 105 are provided between the second-last and the last wheel, in the heel region.

Thanks to the provision of the fastening means in the gap between adjacent wheels, a frame 104 having a height H that is substantially equal to the diameter of the wheels 108 can be obtained.

Nevertheless, the above-disclosed solution also has drawbacks.

More particularly, the increased distance between the fastening points of the skate boot to the frame (equal to about 170-210 mm) considerably increases the stiffness of the frame structure. An excessive stiffness of the skate can involve a low precision in driving the skate, especially when turning, since it is hard to make the skate easily follow bends having small curvature radii.

The main object of the present invention is to provide a solution alternative to prior art, which allows to obtain a skate having an improved precision in driving, while keeping at the same time both the frame height and the distance of the skate boot from the sliding plane limited, so as to guarantee a high stability.

Another object of the present invention is to provide a skate allowing the user to easily manage bends having small curvature radii.

A further object of the present invention is to provide a skate with improved performances in terms of power transmission and speed.

These and other objects are achieved by an in-line roller skate according to the invention, as claimed in the appended claims.

DISCLOSURE OF THE INVENTION

According to the invention, the skate boot is fastened to the skate frame through a fastening portion located at the sides of the frame and provided between the sole of said boot and said frame in a substantially central region in the longitudinal direction between the front wheel and the rear wheel. Thanks to this arrangement, the boot sole can be placed substantially almost contacting the upper profile of the wheels, thus reducing the height of the skate centre of gravity with respect to the sliding plane.

Moreover, always thanks to the arrangement of the invention, the frame can have a vertical size reduced with respect to the wheels diameter, thus reducing the frame weight and, consequently, the skate overall weight.

The frame size reduction further implies a benefit in manufacturing costs, particularly when the frame material is especially expensive.

BRIEF DESCRIPTION OF THE DRAWINGS

Advantages and features of the invention will be evident from the following description of a preferred embodiment of the invention, given by way of non-limiting example, with reference to the attached drawings, wherein.

DESCRIPTION OF A PREFERRED EMBODIMENT OF THE INVENTION

With reference to FIGS. 2 to 5, the in-line roller skate 1 according to the invention comprises a frame 5 including a pair of side frame elements 5*a*,5*b*, joined to each other by at least one transversal frame element 5*c*, wherein said frame elements can be made of metal, for instance aluminium, and said side frame elements 5*a*, 5*b* are preferably made as perforated, shaped plates.

A front wheel 7*a*, a rear wheel 7*b* and one or more (two in the illustrated embodiment) intermediate wheels 7*b*, 7*c* are pivotally mounted between said side frame elements 5*a*, 5*b*, said wheels being arranged in-line and preferably all having the same diameter D.

A skate boot 3 provided with a sole 3*a* and suitable to be worn by the user of the skate 1 is fastened to said frame 5 through a fastening portion 9.

According to the invention, said fastening portion 9 is fastened to the frame 5 at a region F that is substantially central in the longitudinal direction between the front wheel 7*a* and the rear wheel 7*d* of the skate.

Always according to the invention, said fastening portion 9 is advantageously located at the gap provided between the central wheels, i.e. between the two intermediate wheels 7*b* and 7*c* in the illustrated example wherein the skate has four aligned wheels.

Moreover, according to this preferred embodiment of the invention, said boot 3 is fastened to the frame 5 exclusively through said central fastening portion 9.

Figure 1:
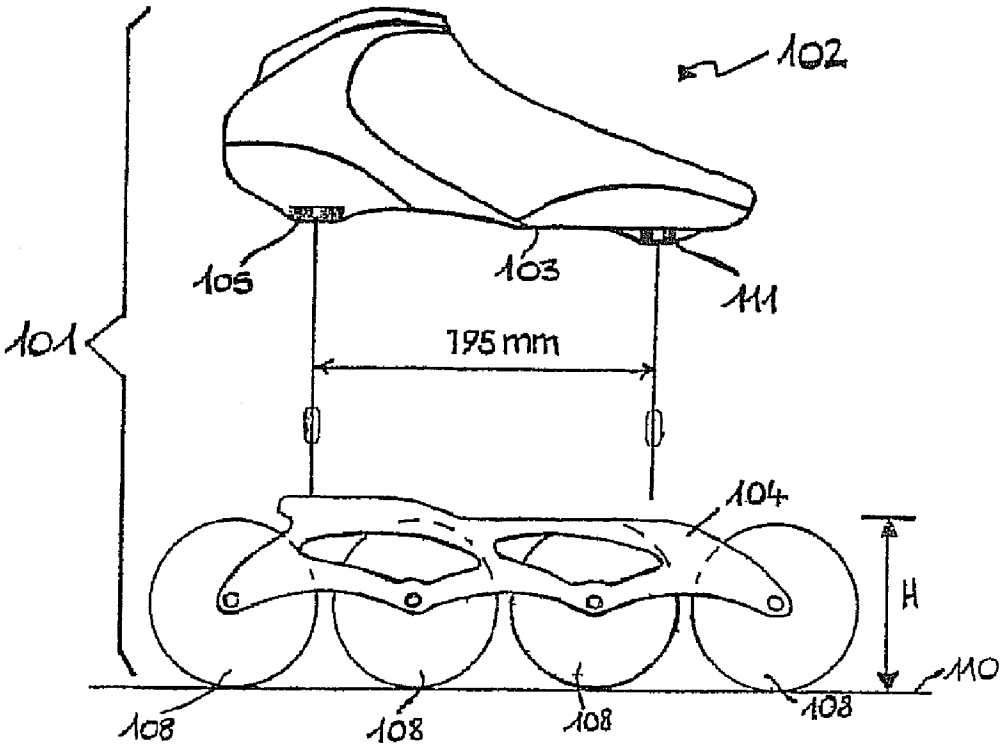
FIG. 1 (PRIOR ART)
FIG. 1 is a side view of an in-line roller skate of the prior art.
Figure 2:
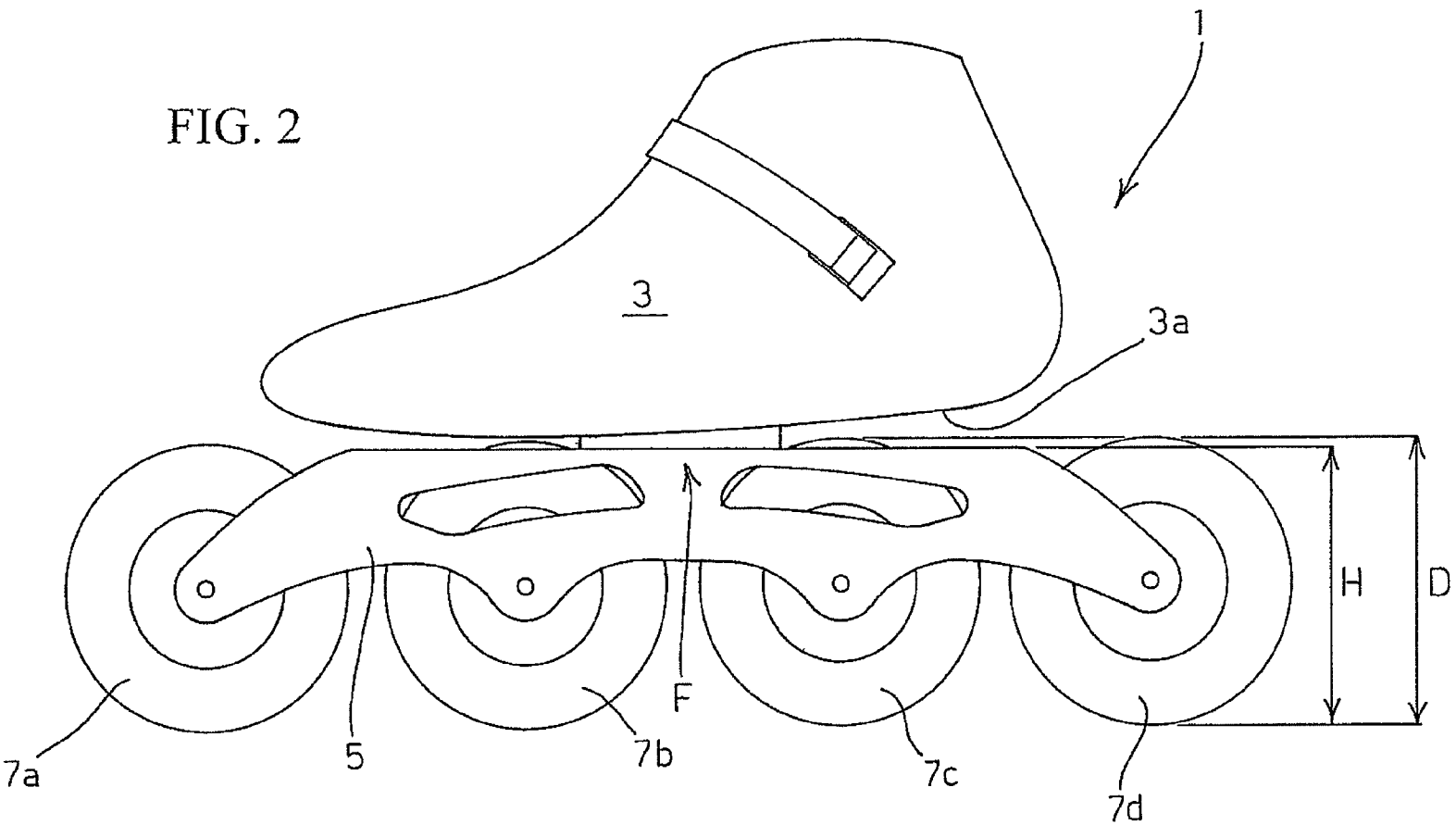
FIG. 2 is a side view of an in-line roller skate according to the invention.

With respect to known solutions of the kind depicted in FIG. 1, owing to the fact that the boot 3 is fastened to the frame at a unique fastening region F, which is central both relative to the boot 3 and to the frame 5, the stiffness of the skate 1 can be reduced, thus improving the precision in driving the skate, especially when turning.

Moreover, always thanks to the fastening at the central region F, provided at the gap between the central wheels, the distance of the boot 3—and, consequently, of the user's centre of gravity—from the sliding plane can be kept limited.

More particularly, as it is evident from the Figures, a skate 1 with a frame 5 having a vertical height H with respect to the sliding plane smaller than the diameter D of the wheels 7*a*-7*d* can be obtained.

For the above reasons, the invention can be particularly—but non exclusively—applied to racing skates, with aligned wheels having an increased diameter, for instance up to 100-110 mm.

Figure 3:
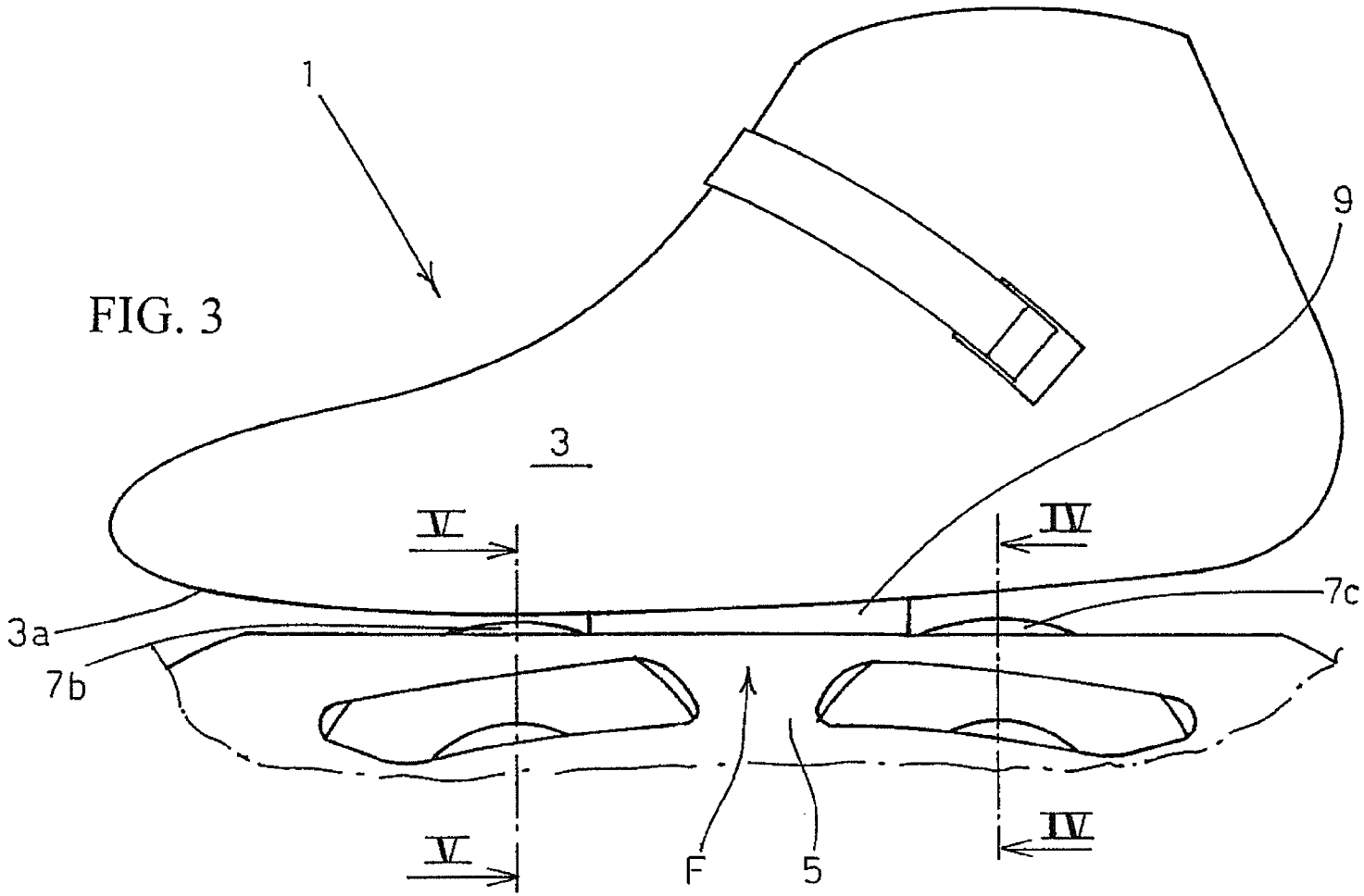
FIG. 3 is an enlarged view of a detail of FIG. 2.

With particular reference to FIG. 3, in the preferred embodiment the fastening portion of the boot 3 to the frame 5 comprises a support 9 integral to the boot 3 and fastened to the frame 5 at the fastening region F, for instance by means of screws or rivets.

Alternatively, it is evident that the support 9 could be integral to the frame 5 at this region F and fastened to the boot sole 3*a* by screws, rivets or the like.

Advantageously, the support 9 is substantially wedge-shaped, tapered towards the front portion of the frame, i.e. towards the toe region of the boot 3, thus guaranteeing a comfortable posture of the user's foot and allowing the optimum power transmission from the user to the skate.

Figure 4:
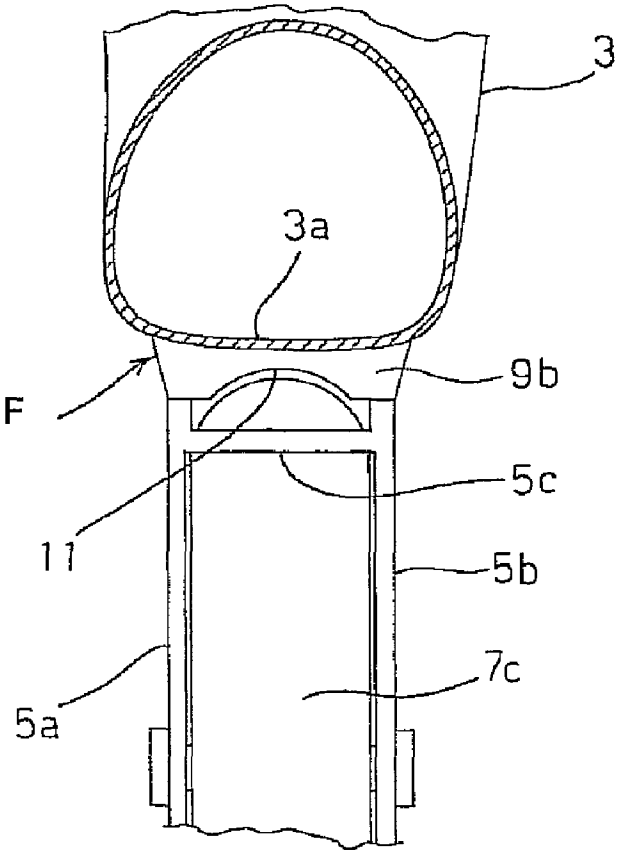
FIG. 4 is a cross-sectional view along line IV-IV of the skate of FIG. 2.

As shown in FIG. 4, the support 9 can be provided, along at least a portion of its length, with a curved cross-section so as to allow the passage of a portion of the wheels. More particularly, according to the illustrated embodiment, the rear portion 9*b* of the support 9 can advantageously include a lower curved recess 11 allowing to receive the upper portion of the wheel 7*c* and to reduce the distance of the sole 3*a* of the boot 3 from the sliding plane.

Figure 5:
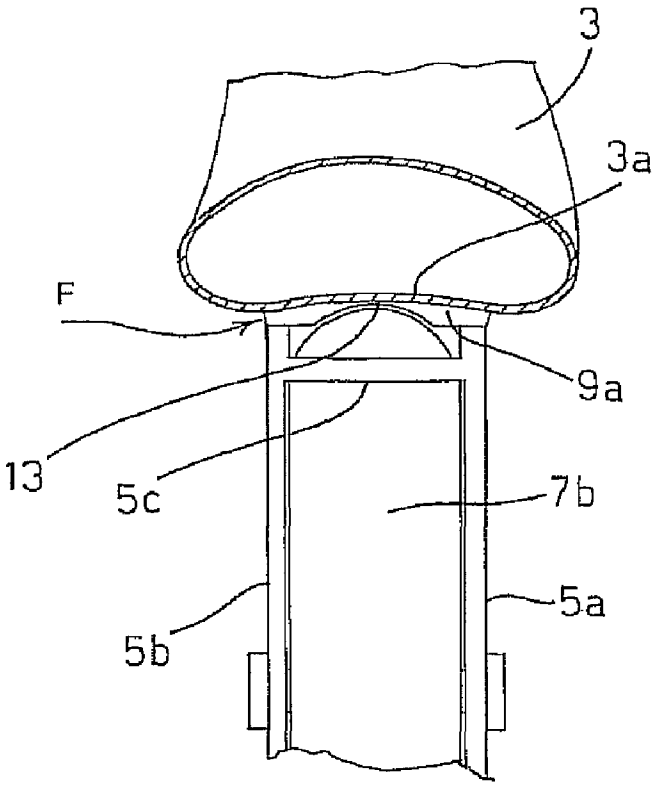
FIG. 5 is a cross-sectional view along line V-V of the skate of FIG. 2.

Analogously, as shown in FIG. 5, the front portion 9*a* of the support 9 can advantageously include a lower central recess 13 allowing to receive the upper portion of the wheel 7*b*.

Accordingly, the corresponding portion of the sole 3*a* of the boot 3 can have—if necessary—a slightly concave profile, always in order to receive the upper portion of the wheel 7*b*.

It is evident from the above description that the invention allows to achieve the objects set forth above, since it provides a skate including a frame on which a plurality of wheels all having the same diameter (more particularly an increased diameter of 100-110 mm) can be mounted, wherein the distance of the user's centre of gravity from the sliding plane can be kept limited without excessively increasing the skate stiffness; thanks to the invention, it is possible to obtain at the same time improved performances both with respect to the stability of the skate and with respect to the precision in driving the skate, the speed and the vibration reduction.

It is also evident that the skate described above with reference to the preferred embodiment of the invention has been given by way of mere example and that several variants and modifications can be made without departing from the scope of protection of the invention as defined in the appended claims.

For instance, it is possible to provide—in accordance with C.I.C. regulation—a racing skate having six aligned wheels; even in this case, the unique fastening point between the shoe sole and the frame will be provided at the gap between two adjacent wheels, namely between the third and the fourth wheel.

Furthermore, the shape and the materials of the different components of the skate, namely of the skate boot and of the frame, can be chosen from time to time so as to accomplish as well as possible the specific needs of the manufacturer or of the user, without any prejudice to the invention.

The invention claimed is:

1. In-line roller skate comprising:

a skate frame comprising a pair of side frame elements, joined to each other by at least one transversal frame element, between which side frame elements, a front wheel, a rear wheel and at least one intermediate wheel are pivotally mounted, and a boot provided with a sole, said boot being fastened to said skate frame through a fastening portion, wherein said fastening portion is located between said sole and said skate frame in a substantially central region in the longitudinal direction between said front and rear wheels, and said boot is fastened to said skate frame exclusively at said central fastening portion.

2. The skate according to claim 1, wherein said wheels all have the same diameter.

3. The skate according to claim 2, wherein said skate frame has a vertical height with respect to the skate sliding plane that is smaller than said diameter of said wheels.

4. The skate according to claim 1, wherein said fastening portion comprises a support.

5. The skate according to claim 4, wherein said support is integral to said boot and fastened to said skate frame.

6. The skate according to claim 4, wherein said support is integral to said skate frame and fastened to said boot.

7. The skate according to claim 4, wherein said support is substantially wedge-shaped, tapered towards the front portion of said skate frame.

8. The skate according to claim 4, wherein said support is provided, along at least a portion of its length, with a curved cross section so as to allow the passage of a portion of the wheels.

9. The skate according to claim 8, wherein a rear portion of said support comprises a lower central recess for receiving the upper portion of one of said wheels.

10. The skate according to claim 8, wherein a front portion of said support comprises a lower central recess for receiving the upper portion of one of said wheels.

11. The skate according to claim 10, wherein a portion of said sole has a concave profile.

12. The skate according to claim 1, wherein said boot is fastened to said skate frame by screws or rivets or by gluing or by welding or the like.

13. The skate according to claim 1, wherein four wheels are provided and wherein said fastening portion is fastened to said skate frame between the two intermediate wheels.

14. The skate according to claim 1, wherein the largest of said wheels has a diameter of about 100-110 mm.

15. The skate according to claim 2, wherein said wheels have a diameter of about 100-110 mm.

16. An in-line roller skate comprising:

a skate frame having a longitudinal direction and supporting in-line and along the longitudinal direction a front wheel, a rear wheel and at least one intermediate wheel; and a boot comprising a sole, the sole fastened to the skate frame through a fastening portion located between the sole and the skate frame in a substantially central region in the longitudinal direction, wherein the sole is fastened to the skate frame only at the substantially central region between the front wheel and the rear wheel.

17. The skate according to claim 16, wherein the skate frame has a vertical height with respect to a sliding plane of the skate that is smaller than an outer diameter for each of the wheels.

18. The skate according to claim 16, wherein the sole is fastened to the skate frame though a support that extends downwards in part between a portion of the at least one intermediate wheel and a portion of a wheel immediately adjacent the at least one intermediate wheel.

19. The skate according to claim 16, wherein the substantially central region is between a rotational axis of the at least one intermediate wheel and a rotational axis of a wheel immediately adjacent to the at least one intermediate wheel.

* * * * *